US006000105A

United States Patent [19]

Lee et al.

[11] Patent Number: 6,000,105

[45] Date of Patent: Dec. 14, 1999

[54] HOOK FOR FIXING A DECORATIVE BAND TO A HAT

[76] Inventors: YoungMin Lee, Han-La Apt. #1103, 798-3 DokChon 2 Dong, Buk-Ku, Pusan, Rep. of Korea; ByungTae Cho, 160 Terminal Dr., Plainview, N.Y. 11803

[21] Appl. No.: 09/159,797

[22] Filed: Sep. 24, 1998

[30] Foreign Application Priority Data

Aug. 28, 1998 [KR] Rep. of Korea ..... 98-35788

[51] Int. Cl.[6] ..... A44B 9/00; A44B 21/00

[52] U.S. Cl. ..... 24/368; 24/3.1; 24/545

[58] Field of Search ..... 24/368, 356, 545, 24/298, 3.1, 7, 13, 114.8; 2/175.1, 195.1

[56] References Cited

U.S. PATENT DOCUMENTS

| | | | |
|---|---|---|---|
| 659,386 | 10/1900 | Austen | 24/368 |
| 785,777 | 3/1905 | Sylvester et al. | 24/368 |
| 888,663 | 5/1908 | Sherwin | 24/545 |
| 982,534 | 1/1911 | Rottger, Jr. | 24/3.1 |
| 1,080,353 | 12/1913 | Kohler | 2/175.1 |
| 1,641,812 | 9/1927 | Johnson | 24/3.1 |
| 2,114,519 | 4/1938 | Beehler | 24/368 |
| 2,577,600 | 12/1951 | Brill | 24/368 |
| 2,755,530 | 7/1956 | Martin | 24/368 |

*Primary Examiner*—Victor N. Sakran
*Attorney, Agent, or Firm*—Notaro & Michalos P.C.

[57] ABSTRACT

A hook for fixing a decorative band to a hat has needles in the form of a fishing needle. For safety, a hole 11 is formed at the center of an elastic iron plate 10 which is bent toward one side. A sharp needle 11 is formed at one inner side of the hole 11, and needles 13 and 14, each in the form of an arrowhead are formed symmetrically outside of the elastic iron plate. A cleave 11*a* may alternatively be formed at the center of a flat elastic iron plate 10*a* with a sharp needle 12*a* formed at the opposite side of the open side of the cleave 11*a*. A needle 14*a*, in the form of an arrowhead, is formed outside of the open side of the cleave 11*a*, with knobs 15 which are inclined downwardly formed symmetrically outside of the open side of the cleave 11*a*.

2 Claims, 8 Drawing Sheets

HOOK FOR FIXING A DECORATIVE BAND TO A HAT

BACKGROUND OF THE INVENTION

1. Field of the Invention

The present invention is related to a hook for fixing a decorative band to a hat to remove a danger in using a hat, to improve a method of using a hat, and to enhance appearance of a hat.

2. Description of the Prior Art

Hats have been used widely from the past. And they have various types. It has been generalized to enclose the fame of the crown of a hat with various decorative bands. The above decorative bands play a role of enhancing nice look of hats. But they have been used practically as publicity media or memorial media. Therefore, it should be convenient to fix the above decorative bands to the crown of a hat and should be convenient to detach them again to store or re-use. A thus-developed decorative band is shown in FIG. 1 in which a needle in the form of a fishing needle is fixed to a front part and a rear part by an adhesive (as known as U.S. hook type). It is natural that the straight portion of the needle is inserted into the inner side of the folded portion of the front part and rear part and is attached by an adhesive. It is very convenient to wind it around the crown of a hat by using the needle. That is, as shown in FIG. 10, a decorative band is fixed to the crown if the needle fixed to the rear part is hooked and fixed to the side of the crown while holding and pulling lightly the front part on the opposite side with a hand and having the rear part and front part move inside so that the needle in the front part is hooked to a proper portion of the decorative band.

However, although this type has been advantageous in that it is possible to attach and detach the decorative band, and it is convenient to embroider at a proper portion of the decorative band, it has been disadvantageous in that frequently a finger, back of the hand, or any other body portion is pierced by the needle which is fixed to the front part and rear part and is hurt. These disadvantages have also occurred frequently when the production factory manufactures decorative bands and when a user encloses a decorative band around the crown. Further, as to a decorative band shown in FIG. 1, if a large number of bands are stored (for example, one doze of decorative bands are packed) and one of them is to be pulled and used later, not only it has been inconvenient to use it but also injury by the needle happens frequently since the needles are entangled or attached to any portion of the decorative band.

Because of danger in storing and inconvenience in using as described in the above, ring-type decorative bands as shown in FIG. 2 have entered into market. Based on FIG. 10, this type of needles have been advantageous in that they are safe in handling as no needle is used, but it has been inconvenient to insert the decorative band to the crown and it has not been nice looking.

SUMMARY OF THE INVENTION

It is therefore an object of the present invention to provide a hook for fixing a decorative band to a hat, which does not have a danger of piercing a portion of a body not only when its large quantity are produced in a production factory but also when it is handled by a user.

Another object of this invention is to provide a hook for fixing a decorative band to a hat, many of which are not hooked together or entangled when they are stored at the same time or one of them are pulled out to be used.

BRIEF DESCRIPTION OF THE DRAWINGS

The foregoing and other objects, aspects and advantages will be better understood from the following detailed description of preferred embodiments of the invention with reference to the drawings, in which.

DETAILED DESCRIPTION OF PREFERRED EMBODIMENTS OF THE INVENTION

Figure 1:
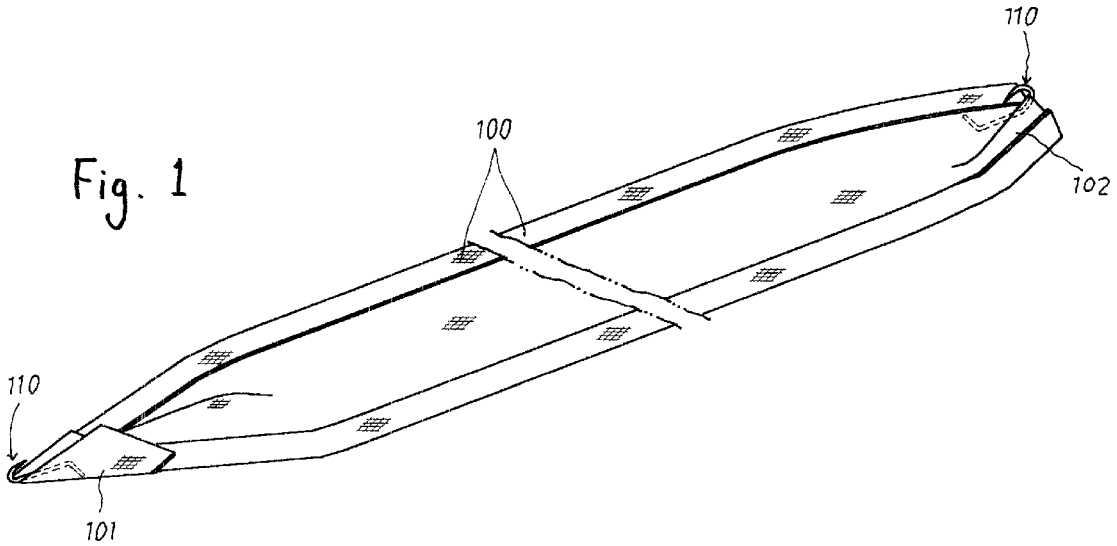
FIG. 1 is a reference perspective view showing a conventional decorative band (U.S. hook type)
Figure 2:
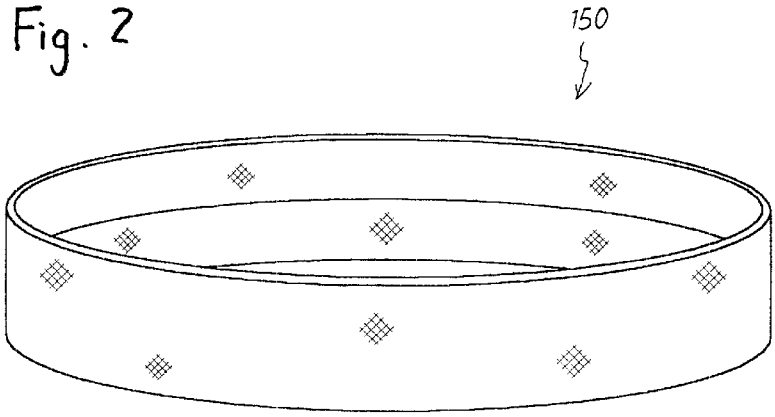
FIG. 2 is a reference perspective view showing a conventional ring-type decorative band.

Preferred embodiments of the present invention are then described in detail with reference to drawings attached.

In order to achieve the above-identified objects, the present invention is characterized by a hold 11 formed at the center of an elastic iron plate 10 which is bent toward one side while drawing a rounding; a sharp needle 12 formed at one inner side of the hole 11; and needles 13 and 14 in the arrowhead form formed symmetrically outside of the elastic iron plate.

The present invention is further characterized by a cleave 11*a* formed at the center of a flat elastic iron plate 10*a*; a sharp needle 12*a* formed at the opposite side of the open side of the cleave 11*a*; a needle 14*a*, of which end has a form of an arrowhead, formed outside of the open side of the cleave 11*a*; downwardly inclined knobs 15 formed symmetrically outside of the open side of the cleave 11*a*; and a needle 13*a*, of which end has a form of an arrowhead, formed as an entity at the end portion of the opposite side of the needle 14*a*.

The present invention is still further characterized by a hole 11*b* formed at the center of an elastic iron plate 10*b* which is bent while drawing a rounding toward one side; a sharp needle 12*b* formed at one inner side of the hole 11*b*;

each projection piece 15*b* overlapped up and down and fixed by a rivet 16; a needle 14*b*, of which end has a form of an arrowhead, formed outside of the projection piece laid on top; and a needle 13*b*, of which end has a form of an arrowhead, formed as an entity at the end portion of the opposite side of the needle 14*b*.

Figure 3A:
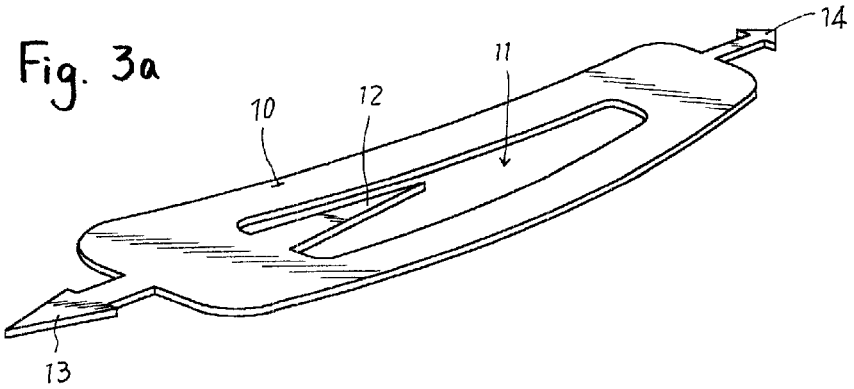
FIG. 3*a* is a perspective view according to the first embodiment of the present invention.
Figure 3B:
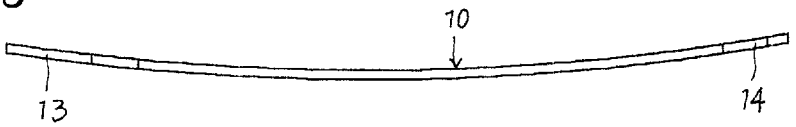
FIG. 3*b* is a front view of FIG. 3*a;*

FIGS. 3*a*, 3*b*, and 3*c* show hooks according to the first, second, and third embodiments of the present invention. They are made of an elastic iron plate, i.e., spring steel or another heat-treated and highly elastic material. Their entire surfaces may be coated with a paint or another anti-corrosive pigment, or still further, an epoxy resin, etc. at times. A hook according to the present invention can be made of an elastic and highly durable plastic, not limited to an elastic iron plate.

A hook shown in FIG. 3*a* is bent entirely toward one side while drawing a rounding by the pressing process. Its state is shown in FIG. 3*b*. The difference in the degree of bending may be somewhat large or somewhat smooth. A hold 11 is formed inside of an elastic iron plate 10, and a sharp needle 12 is formed as an entity at one end of the hole 11. Needles 13 and 14, of which ends have a form of an arrowhead, are formed outside as an entity. That is, a hook shown in FIG. 3 is manufactured in one process of pressing process.

Figure 4A:
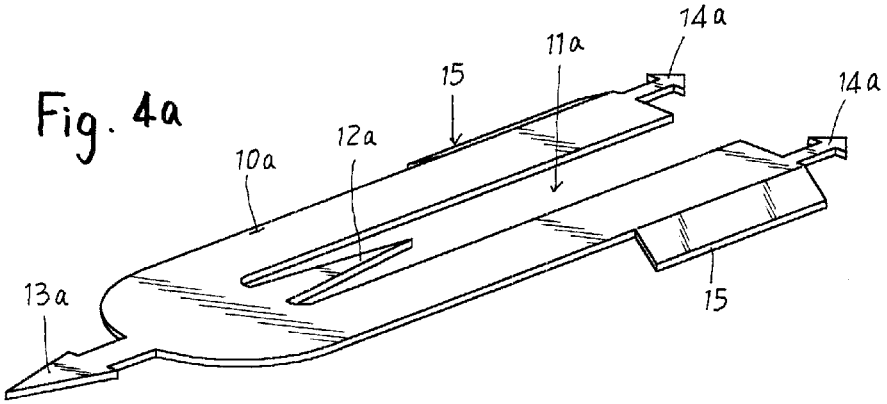
FIG. 4*a* is a perspective view according to the second embodiment of the present invention.
Figure 4B:
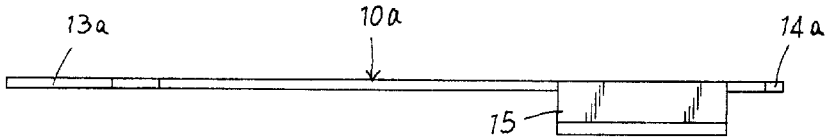
FIG. 4*b* is a front view of FIG. 4*a;*

A hook shown in FIG. 4*a* is not bent but is entirely flat, and is manufactured in one process of pressing process. A cleave 11*a*, of which one side is open, is formed at the center of an elastic iron plate 10*a*, and a sharp needle 12*a* is formed at the opposite side of the open side of the cleave 11*a*. Needles 14*a* are formed at each open side of the cleave 11*a*, downwardly inclined knobs 15 are symmetrically formed adjacent to the above, and finally a needle 13*a* is formed as an entity. Its front view is shown in FIG. 4*b*.

Figure 5A:
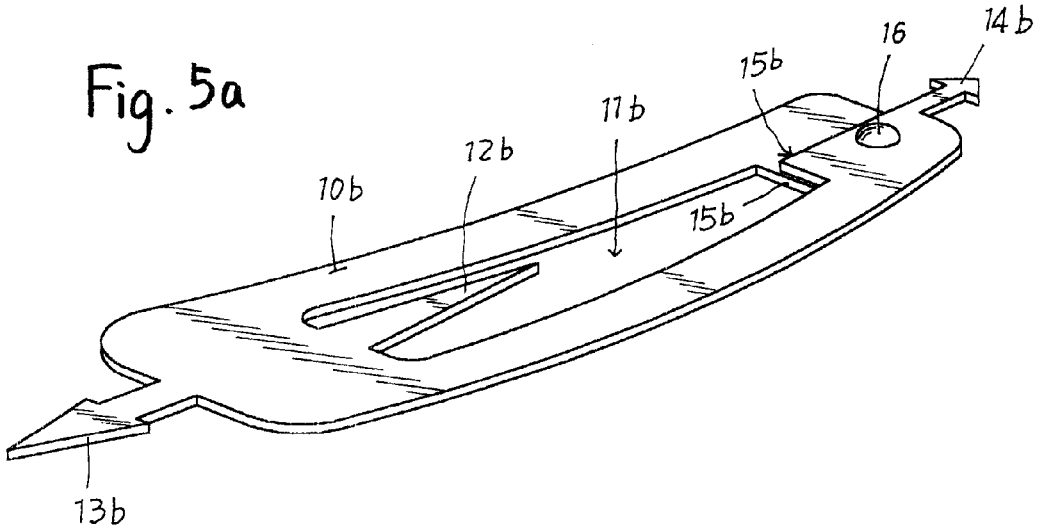
FIG. 5*a* is a perspective view according to the third embodiment of the present invention.
Figure 5B:
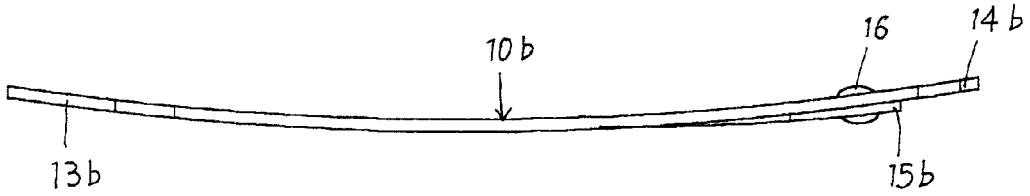
FIG. 5*b* is a front view of FIG. 5*a;*

A hook shown in FIG. 5*a* has an almost similar structure as that shown in FIG. 3*a*, but is different as follows: That is, the compositions of needles 13*b* and 12*b* and a hole 11*b* are similar but their manufacturing processes are different. If the pressing process is performed without a rivet 16, needles 13*b* and 12*b*, a hole 11*b*, a projection piece 15*b*, and a needle 14*b* are manufactured in one process simultaneously for an elastic iron plate 10*b*. Of course at this stage, the entire elastic iron plate 10*b* is processed in a flat state contrary to a hook in FIG. 3*a*. However, it is natural to form a hole, into which a rivet 16 can be inserted, at the center of a projection piece 15*b*. And to be noted is that a needle 14*b* is formed at only one of projection pieces. If an elastic iron plate is manufactured by the pressing process as described in the above, projection pieces are set apart on the plane facing each other while maintaining a little distance from each other. Next, two projection pieces are overlapped and fixed by sticking in a rivet 16 so that projection pieces 15*b* are overlapped. At this time, it is better to have a projection piece at which a needle 14*b* is formed face upward. An elastic iron plate 10*b* is naturally bent by a hole 11*b* if two projection pieces are pulled to overlap and are fixed by a rivet. This state is shown in FIG. 5*b*.

Figure 6A:
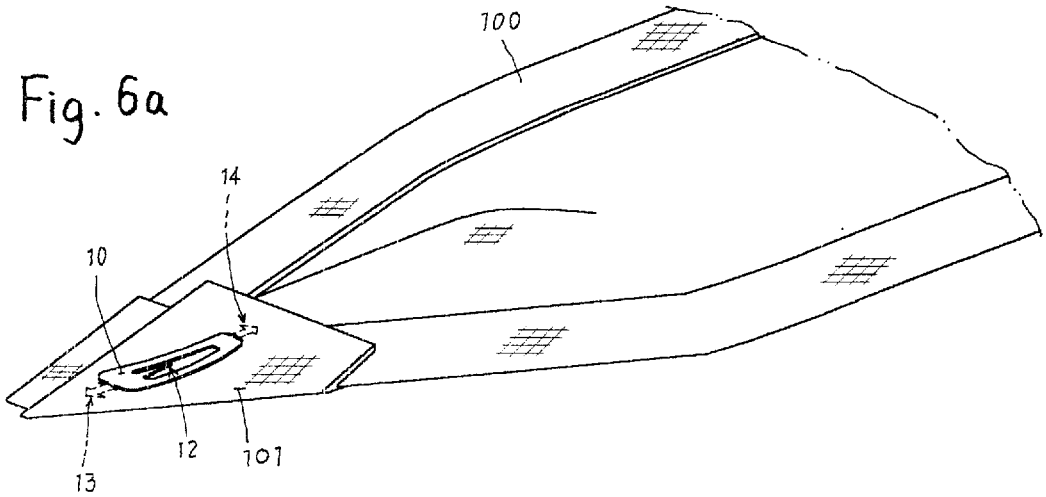
FIGS. 6*a*, 6*b*, and 6*c* are reference perspective views showing that a hook in the present invention is fixed to the end combining portion of a decorative band.
Figure 6B:
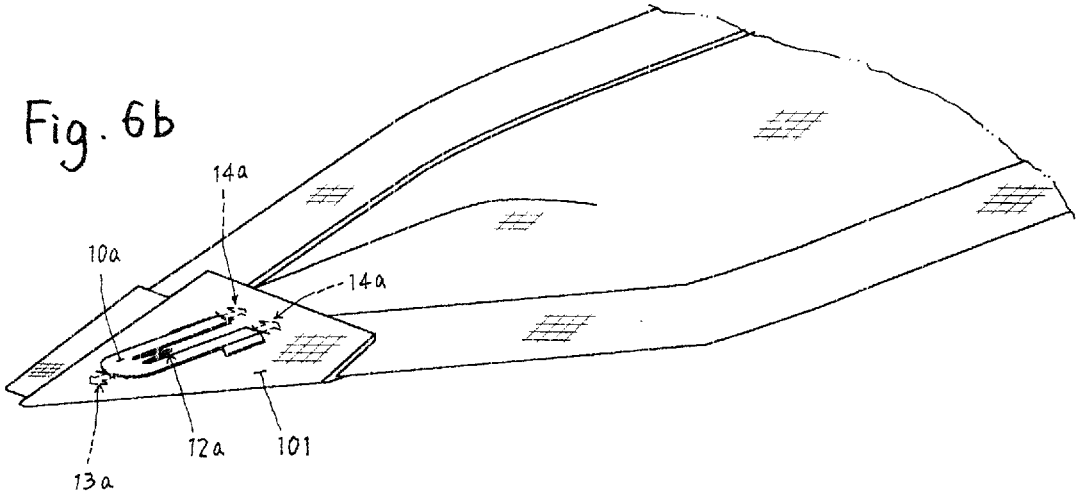
Figure 6C:
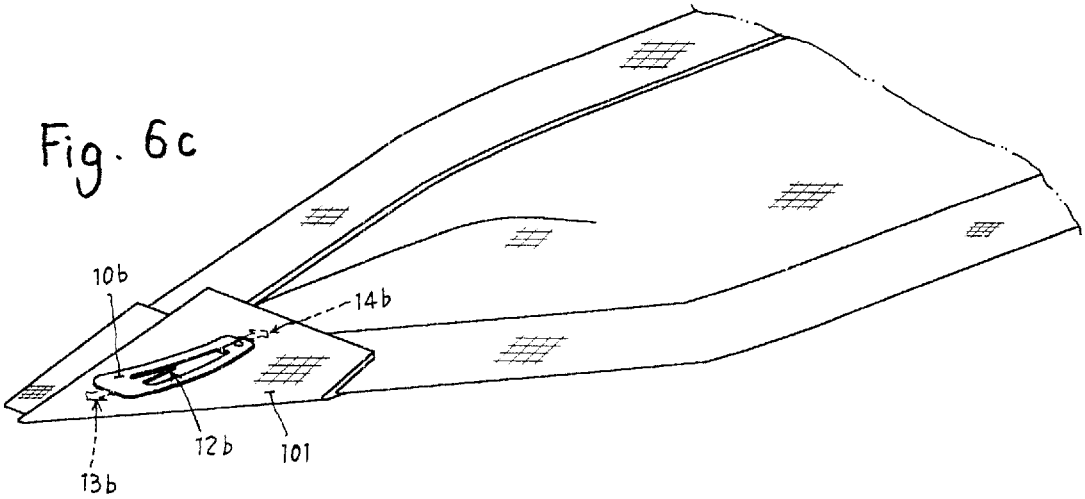

The states in which these are fixed to a front part 101 or a rear part 102 of a decorative band 100 are shown in FIGS. 6*a*, 6*b*, and 6*c*. Here, the state in which these are fixed to the rear part 102 is not shown since it is the same as that in which these are fixed to the front part 101. It is seen in FIGS. 6*a*, 6*b*, and 6*c* that needles 13 and 14, 13*a* and 14*a*, and 13*b* and 14*b*, of which ends have a form of an arrowhead, are shown in dotted lines in each elastic iron plate. The reason for it is that the above needles 13 and 14, 13*a* and 14*a*, and 13*b* and 14*b* are stuck into the inner surface of the front part 101. Since ends of the above needles 13 and 14, 13*a* and 14*a*, and 13*b* and 14*b* are in the form of an arrowhead, it is not possible to pull them out once they are stuck in. Therefore, they are reliable and especially safe.

Figure 10:
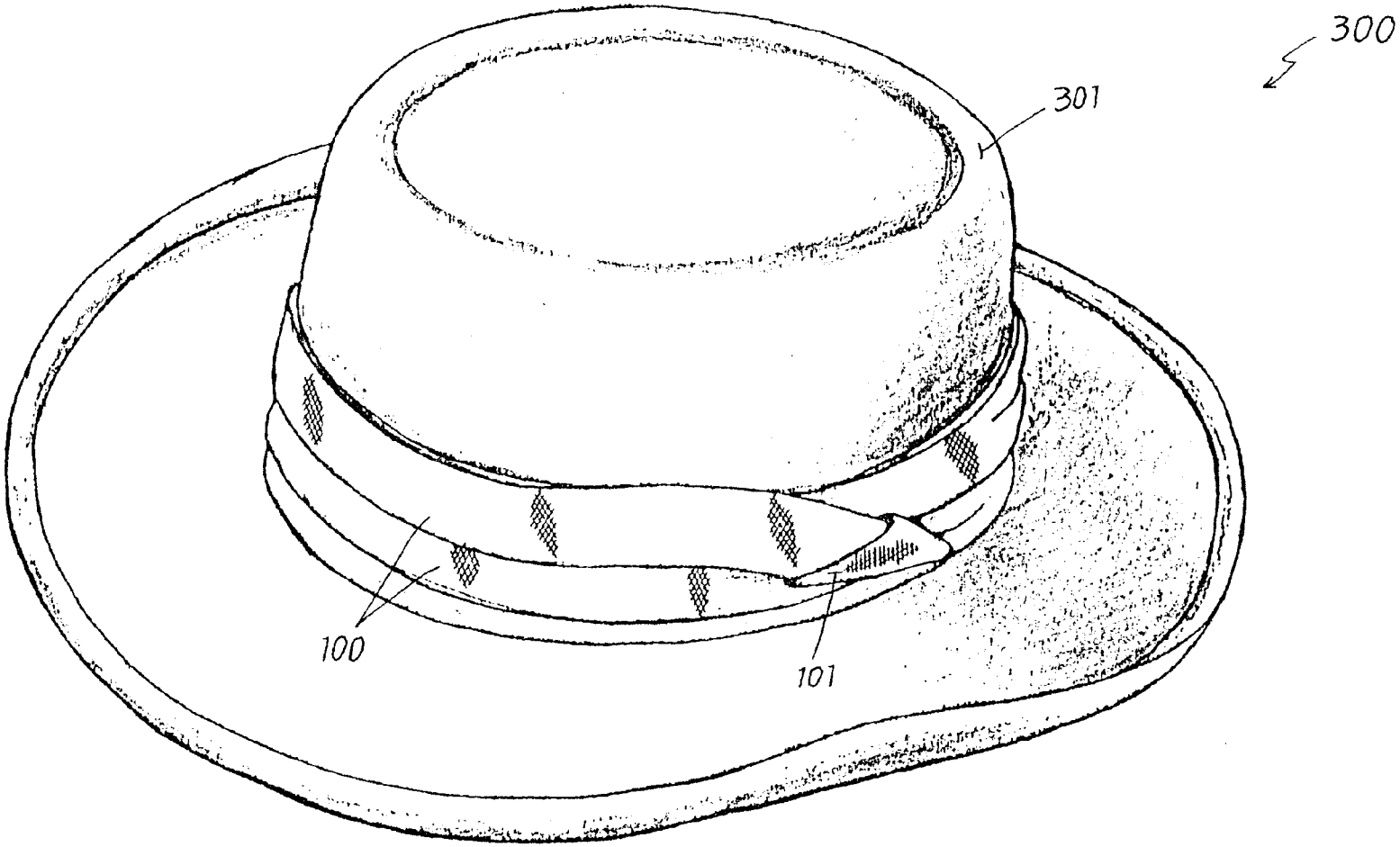
FIG. 10 is a reference perspective view showing that a decorative band is fixed to the lower frame of the head wearing portion of a hat.

Next, described below is how to fix a decorative band to the crown 301 of a hat by using a hook in the present invention. As a method of using a hook in FIG. 3*a* and that in FIG. 5*a* are the same, a method of using is illustrated based on FIG. 3*a*. That of using a hook in FIG. 4*a* is somewhat different, and therefore, is illustrated separately. There are many kinds of hats however, and therefore, a hat shown in FIG. 10 is used for describing how to use a hook in the present invention.

Figure 7A:
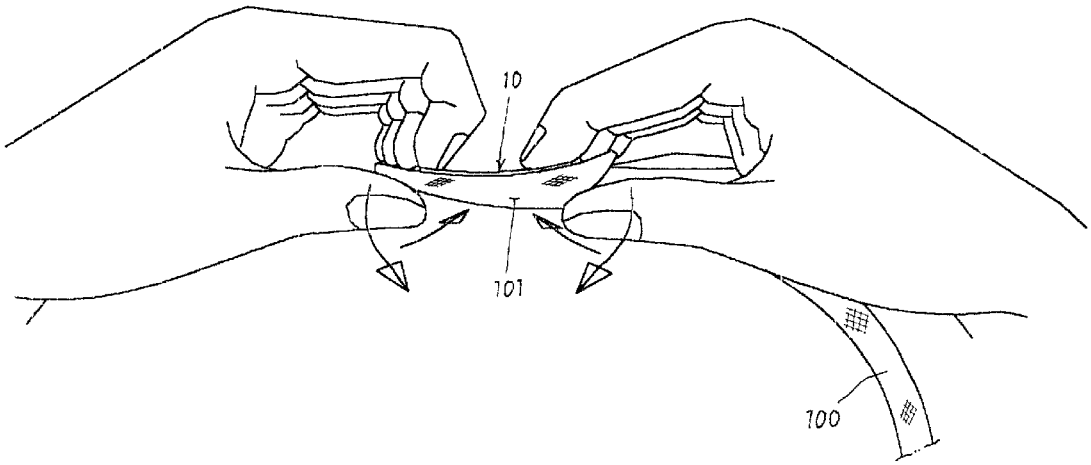
FIG. 7*a* is a reference view showing that a hook according to the first embodiment of the present invention is bent by using fingers of both hands.
Figure 7B:
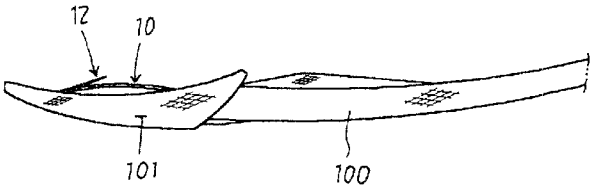
FIG. 7*b* is a reference view showing that a hook according to the first embodiment of the present invention is bent and a needle is protruded.
Figure 8:
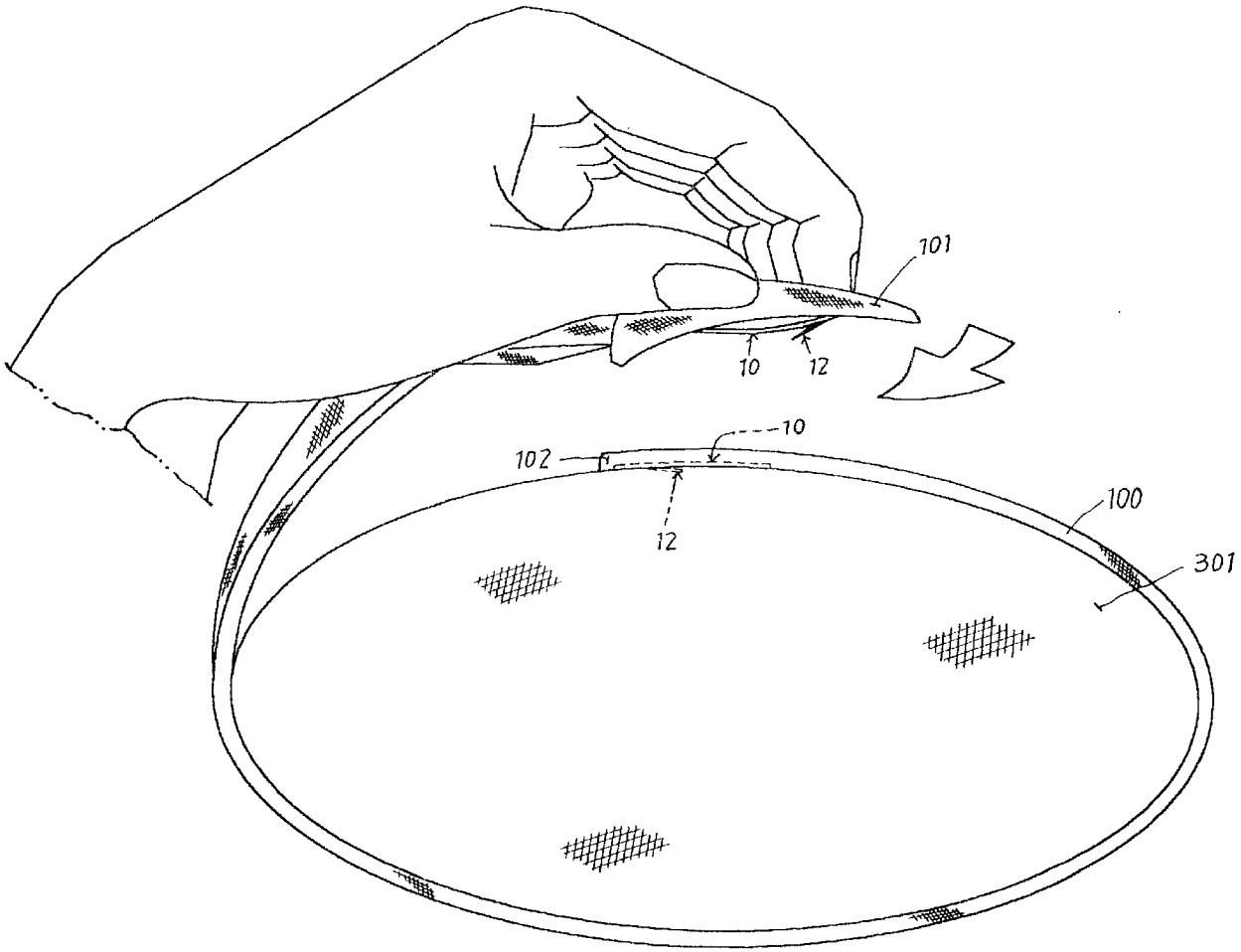
FIG. 8 is a reference view showing how to wind and fix a decorative band around the lower frame of the head wearing portion of a hat by using a hook according to the first embodiment of the present invention.

It is seen in FIG. 7*a* that an elastic iron plate 10 is located at the upper portion of the front part 101 while it is bent downwardly. It is safe though since a needle 12 is not protruded. As shown in FIG. 7*a*, both ends of the elastic iron plate 10 in the lengthwise direction are lowered, while the central part of the elastic iron plate 10 is lifted up. Fingers of both hands should be used at this time. Then the central part of the elastic iron plate 10 is bent upwardly maintaining an arch form, as shown in FIG. 7*b*, and the needle 12 is protruded maintaining a straight line naturally. Of course, it is natural in this state that if the elastic iron plate 10 is bent as is, it is restored by its inherent elasticity and is returned to the state shown in FIG. 7*a*. Next, although it is not shown in figures, as illustrated in the above, the needle 12 is protruded by bending the elastic iron plate which is fixed to the rear part 102 as in FIG. 7*b*. However, in fact, the elastic iron plate which is fixed to the rear part 102 has to be bent first. The reason for that is that the elastic iron plate which is fixed to the rear part 102 has to be bent first and fixed first to the center of the side of the crown 301 as shown in FIG. 8. It is seen in FIG. 8 that the needle 12 of the elastic iron plate which is fixed to the rear part 102 is stuck first in the crown 301. It is because the rear part 102 has to be located inside of the front part 101 as described in the above. The needle 12 is protruded by bending the elastic iron plate which is fixed to the rear part 102, after which the needle 12 is stuck into the side of the crown 301. Next, it is important to bend the elastic iron plate again in the opposite direction, i.e., the opposite direction to the direction of bending so that the needle 12 is protruded (as in the state of FIG. 7*a*), in order not to have the needle 12 penetrate through the crown 301. It is because a possible danger of injuring the skin of the head of a user has to be taken into consideration if the needle 12 penetrates the crown. Therefore, once the needle 12 is stuck into the crown, care should be taken not to have the needle 12 penetrate through the crown by bending the elastic iron palte again as is so that the needle 12 is forced to suck into a hole 11 as it is stuck by the restoring power of the elastic iron plate.

Next, as described in the above, the needle 12 is protruded by bending the elastic iron palte which is fixed to the front part 101 as shown in FIG. 7*b*, after which the front part 101 is held lightly with fingertips and moved close to the decorative band while having the needle 12 face the crown as shown in FIG. 8. As the needle 12 comes close to the decorative band, it is stuck into the band while pulling the front part 101 a little forcefully. This will make the decorative band 100 be fixed to the crown as the rear part 102 is covered by the front part 101 on its top. If the needle 12 of the front part 101 is stuck into the decorative band, it is of course important not to have the needle 12 penetrate the crown by bending the elastic iron plate in the original direction. The decorative band is fixed to the head wearing portion as described in the above. If it is desired to detach the decorative band, it is possible to untie it from the crown by removing the needle 12 from the decorative band while holding up the front part 101 a little and doing the same for the rear part 102 again. To be noted here very importantly is that once needles 12, 12*a*, and 12*b* formed at a hook of the present invention are pulled out after they are stuck into the crown or decorative band, they are not protruded by the restoring power of the elastic iron plate immediately but return to the original state. After that, as described in the above, it is possible to fix and use the decorative band for another hat, or to fix and use a different, i.e., new, decorative band for the crown of another hat.

Figure 9:
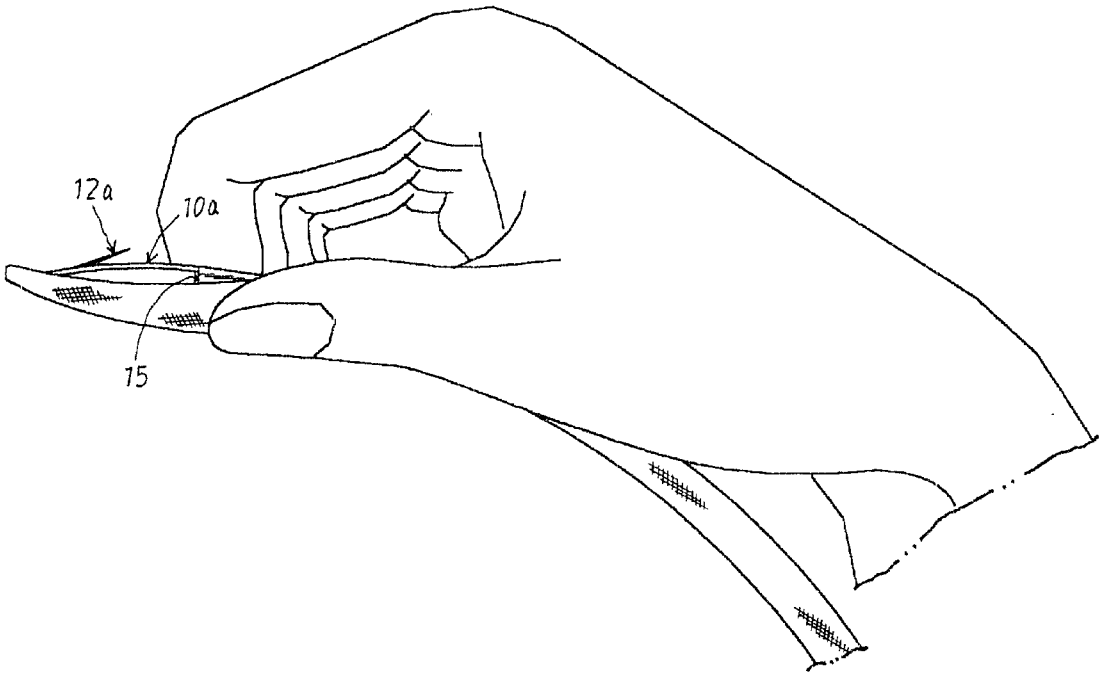
FIG. 9 is a reference view showing that a needle is protruded by tightening a hook according to the second embodiment of the present invention with fingers.

Next, shown in FIG. 9 briefly is a method of using a hook in FIG. 4*a*. Downwardly inclined knobs 15 in FIG. 4*a* are formed symmetrically. Therefore, described below is a method of fixing the decorative band to the crown by fixing the needle 12*a* to the front part 101 or rear part 102 as shown in FIG. 6*b*, and having it be protruded when necessary. The elastic iron plate 10*a* is twisted and bent upwardly as knobs 15 are gathered together toward the cleave 11*a* at the center using fingers of one hand a little forcefully. Accordingly, as shown in FIG. 9, the elastic iron plate 10*a* is bent upwardly, and the needle 12*a* is protruded. If the needle 12*a* is stuck into the crown and the force imposed on knobs 15 is removed at the same time in this state, knobs 15 return to their original positions and the elastic iron plate 10*a* is restored to the flat state. As the needle 12*a* is stuck into the crown, a force to be flat along the elastic iron palte 10*a* is acted upon the needle 12*a*, and therefore, the needle 12*a* is well fixed without being stuck too deeply into the crown or without penetrating the crown.

As illustrated in the above, hooks in the present invention are safe since needles 12, 12*a*, and 12*b* are not protruded when hooks are fixed to the front or rear part of the decorative band (i.e., when they are not yet used); and are also safe since they do not penetrate through the crown when they are being used. Accordingly, there is no danger with respect to the safety of needles 12, 12*a*, and 12*b*.

In conclusion, it is convenient to handle and safe to use a hook in the present invention particularly for both a manufacturer or user since needles 12, 12*a*, and 12*b* are protruded if only they are bent forcefully, but are not protruded from the elastic iron plate during the usual time (when they are stored). Also it is effective for preventing accidents in view of safety which can occur accidentally by not having needles 12, 12*a*, and 12*b* penetrate through the crown when the decorative band is enclosed around and fixed to the crown. Further, movement of a hook in the present invention when the elastic iron plate is bent or unbent, i.e., elastic of the elastic iron plate, can be detected sensually through fingers, and therefore, its reliability can be improved compared to a hook of the conventional type. Still further, a hook in the present invention, which has a superior elasticity and restoring power, is advantageous in that the fixed state of the decorative band in view of appearance is superior than that in the past as the decorative band is moved close to the crown tightly and fixed.

While the invention has been described in terms of a few preferred embodiments, those skilled in the art will recognize that the invention can be practiced with modification within the spirit and scope of the appended claims.

What is claimed is:

1. A hook for fixing a decorative band to a hat characterized by:

a cleave formed at the center of a flat elastic iron board;

a first sharp needle formed at the opposite side of the open side of said cleave;

two second needles, of which ends are in the form of an arrow, formed outside of the open side of said cleave;

two downwardly inclined knobs formed symmetrically outside of the open side of said cleave; and a third needle, of which end is in the form of an arrowhead, formed as an entity at the end portion of the opposite side of said second needles.

2. A hook for fixing a decorative band to a hat characterized by:

a hole formed at the center of an elastic iron plate which is bent toward one side while drawing a rounding;

a sharp needle formed at one inner side of said hole;

two projection pieces overlapped up and down and fixed by a rivet;

a first needle, of which end is in the form of an arrowhead, formed outside of a projection piece laid on top; and a second needle, of which end is in the form of an arrowhead, also formed as an entity at the end portion of the opposite side of said first needle.

* * * * *